US005411425A

United States Patent [19]

Rinker

[11] Patent Number: 5,411,425

[45] Date of Patent: May 2, 1995

[54] FLOATATION APPARATUS AND METHODS

[76] Inventor: David E. Rinker, P.O. Box 5206, Cottonwood, Calif. 96022

[21] Appl. No.: 812,879

[22] Filed: Dec. 20, 1991

[51] Int. Cl.[6] ..... B63C 9/08

[52] U.S. Cl. ..... 441/130; 114/123; 114/363; 441/129

[58] Field of Search ..... 114/374, 360, 123, 69, 114/363; 441/126, 88, 129, 130, 131, 132

[56] References Cited

U.S. PATENT DOCUMENTS

| | | | |
|---|---|---|---|
| 242,448 | 6/1881 | Hall | 114/360 |
| 883,588 | 3/1908 | Thatcher | 114/69 |
| 1,503,624 | 8/1924 | Bauman et al. | 441/132 |
| 1,562,276 | 11/1925 | Assenzio | 441/132 |
| 1,622,508 | 3/1927 | Harper | 114/360 |
| 2,623,574 | 12/1952 | Damsch | 441/126 |
| 2,803,839 | 8/1957 | Mosley | 441/131 |
| 4,598,659 | 7/1986 | Chinnery | 114/123 |
| 4,768,459 | 9/1988 | Cerkvenik et al. | 114/363 |
| 4,838,196 | 6/1989 | Ingram | 114/347 |

FOREIGN PATENT DOCUMENTS

| | | | |
|---|---|---|---|
| 185919 | of 1922 | Australia | 441/130 |
| 26721 | 4/1981 | European Pat. Off. | 114/123 |
| 3639296 | 4/1988 | Germany | 114/123 |

*Primary Examiner*—Stephen P. Avila
*Attorney, Agent, or Firm*—Joseph E. Gerber

[57] ABSTRACT

A floatation unit comprised of a generally rectangular air bag, and having an inflation hose and valve, is disclosed. Four grab loops project from the four corners of the air bag, two of the corners also including hooks for engaging a water craft's gunwale, the other two of the corners including cinch straps. A pair of the floatation units is used to stabilize a water craft by engaging the hooks of each to opposing gunwales of the craft, and tensioning their cinch straps beneath the craft. A pair of floatation units is also used to displace space with a water craft, thereby reducing its likelihood of sinking if swamped. For displacement, each of the pair of units is hooked to a thwart within the water craft, and their cinch straps are tensioned between them to suspend the units securely between the thwarts. A pair of the units may also support a seat panel between them, the seat panel having corner loops through which the cinch straps pass. A person can be supported substantially upright in the water on the seat panel. Upright support is also possible if a person passes each leg through a gap between an air bag and its cinch straps, the straps of each unit being attached to one another of the same unit. And, a single floatation unit may support a person in a generally prone position in the water if the person's torso is through a gap between the air bag and the attached cinch straps, the upper chest and arms being atop the air bag while the hips and legs hang free for kicking.

30 Claims, 8 Drawing Sheets

FIG.—9
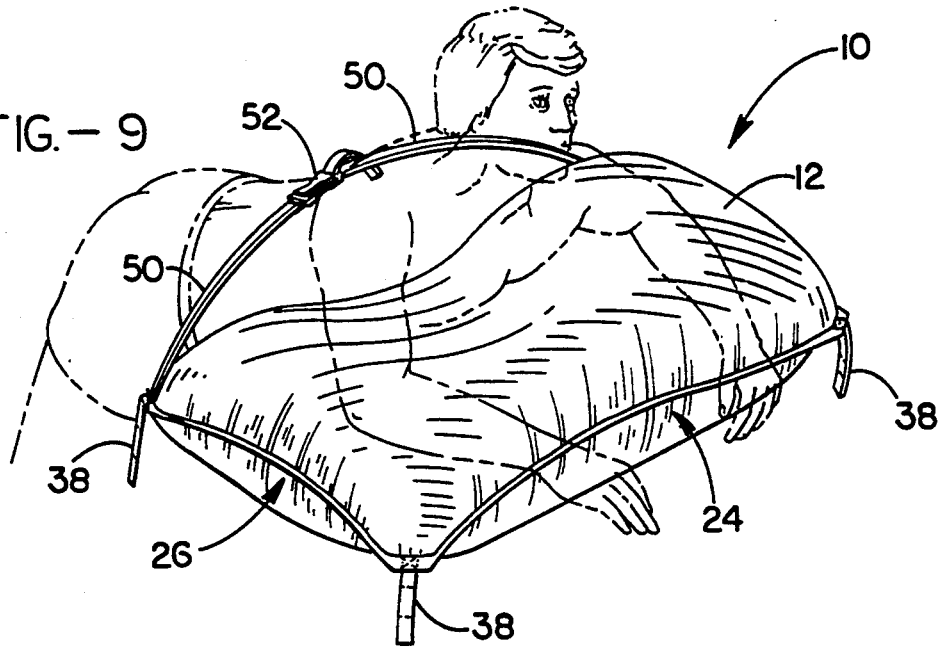
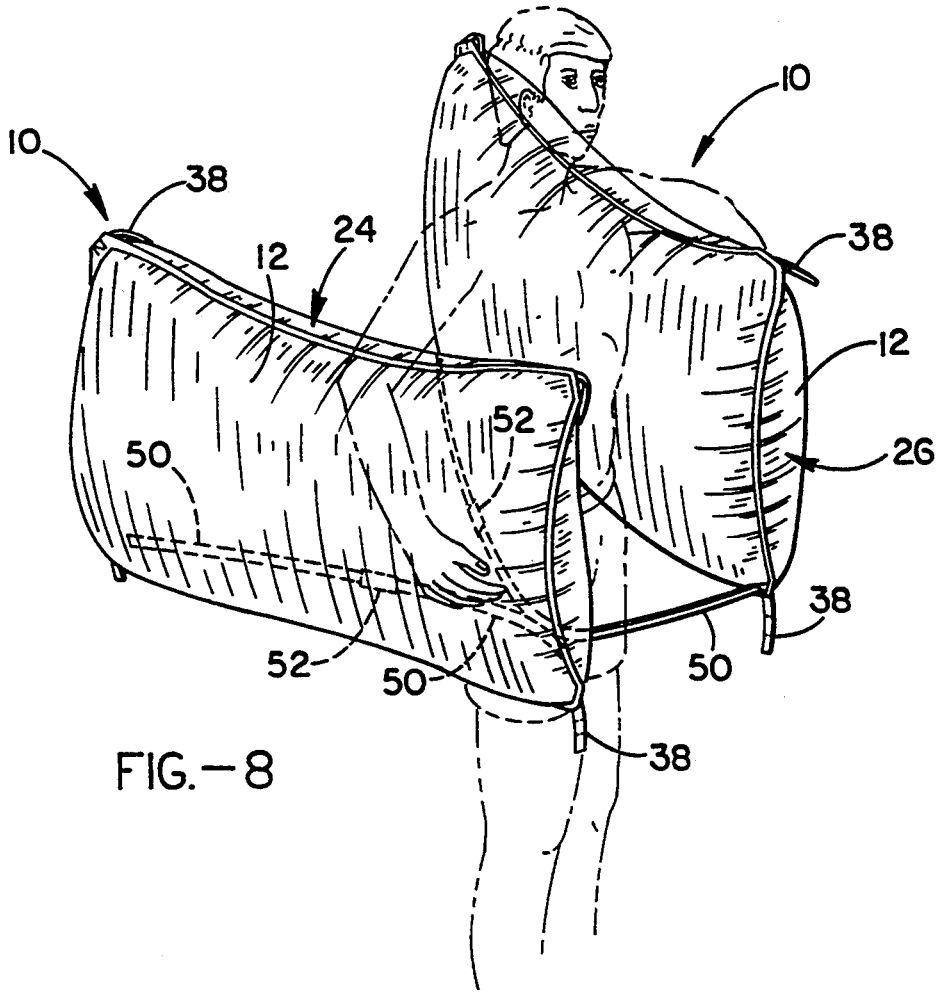
FIG.—8

FLOATATION APPARATUS AND METHODS

BACKGROUND OF THE INVENTION

1. Field Of The Invention

The present invention relates generally to floatation devices, and more specifically to multi-purpose floatation apparatus for stabilizing water craft, for displacing space in water craft and for supporting persons, and to methods of using this apparatus.

2. Description Of The Related Art

Throughout the history of humankind's construction and use of water craft, various stabilizing devices such as outriggers and pontoons have been employed to minimize the likelihood of tipping over. Such stabilizers are primarily fitted to narrow-beamed boats, such as canoes and the like, to offset their inherent tendency to tip. However, complex hardware and apparatus suited only to permanent installation often make previously-available stabilizers impractical to use.

It has also been found advantageous to employ displacement apparatus in water craft to keep it from sinking, if swamped. Various high volume, low density solid materials and air-filled bladders have been used for this purpose. However, each of those currently available tends to be fashioned to fit a water craft of a particular shape and dimensions.

It would be particularly expedient if a single, highly adaptable floatation apparatus were available to serve as a water craft stabilizer or, alternatively, to displace space within the interior of a water craft. Further advantages would be derived from the apparatus if it could be adapted to supporting a person in water for recreational or emergency use.

SUMMARY OF THE INVENTION

The floatation unit and apparatus of the present invention, and the methods of their use, are adapted to overcome the above-noted shortcomings and to fulfill the stated needs.

The individual floatation unit claimed herein comprises a generally rectangular, inflatable air bag having grab loops fastened to each one of four generally defined corners; hooks fitted to each of two of the air bag's directly opposed corners; cinch straps fastened to each of those two of the air bag's corners not having hooks; and, means bound to an end of one of the cinch straps for attachment to a free end of the other cinch strap. This basic unit is combined with a water craft in two inventive ways to yield floatation apparatus. First, a pair of the units is deployed along a water craft's sides as stabilizers, their hooks being engaged with the water craft's gunwales and their cinch straps passing beneath the water craft's underside. Second, a pair is deployed within a water craft to displace space, their hooks being engaged with the water craft's thwarts and their cinch straps tensioning them into secure support between the thwarts. A pair of the units may also be employed, with or without a rectangular seat panel, to support a person substantially upright in the water.

The methods of carrying out the above uses are claimed, as well.

Thus, it is an object of the present invention to provide a floatation unit of such versatility that it may be employed to either stabilize or displace space within a water craft.

It is a further object of the present invention to provide a floatation unit that may be employed in a variety of ways to support a person in the water.

Still further objects of the inventive floatation unit and apparatus disclosed herein will be apparent from the drawings and following detailed description thereof.

BRIEF DESCRIPTION OF THE DRAWINGS

FIG. 8 is a perspective view of a person supported in water by having each leg through a gap between a cinch strap and the long end of a floatation unit's air bag.

FIG. 9 is a perspective view of a person supported in water by having the upper chest and arms atop the air bag of a floatation unit, and having the cinch straps buckled around the torso.

DESCRIPTION OF THE PREFERRED EMBODIMENT

Figure 1:
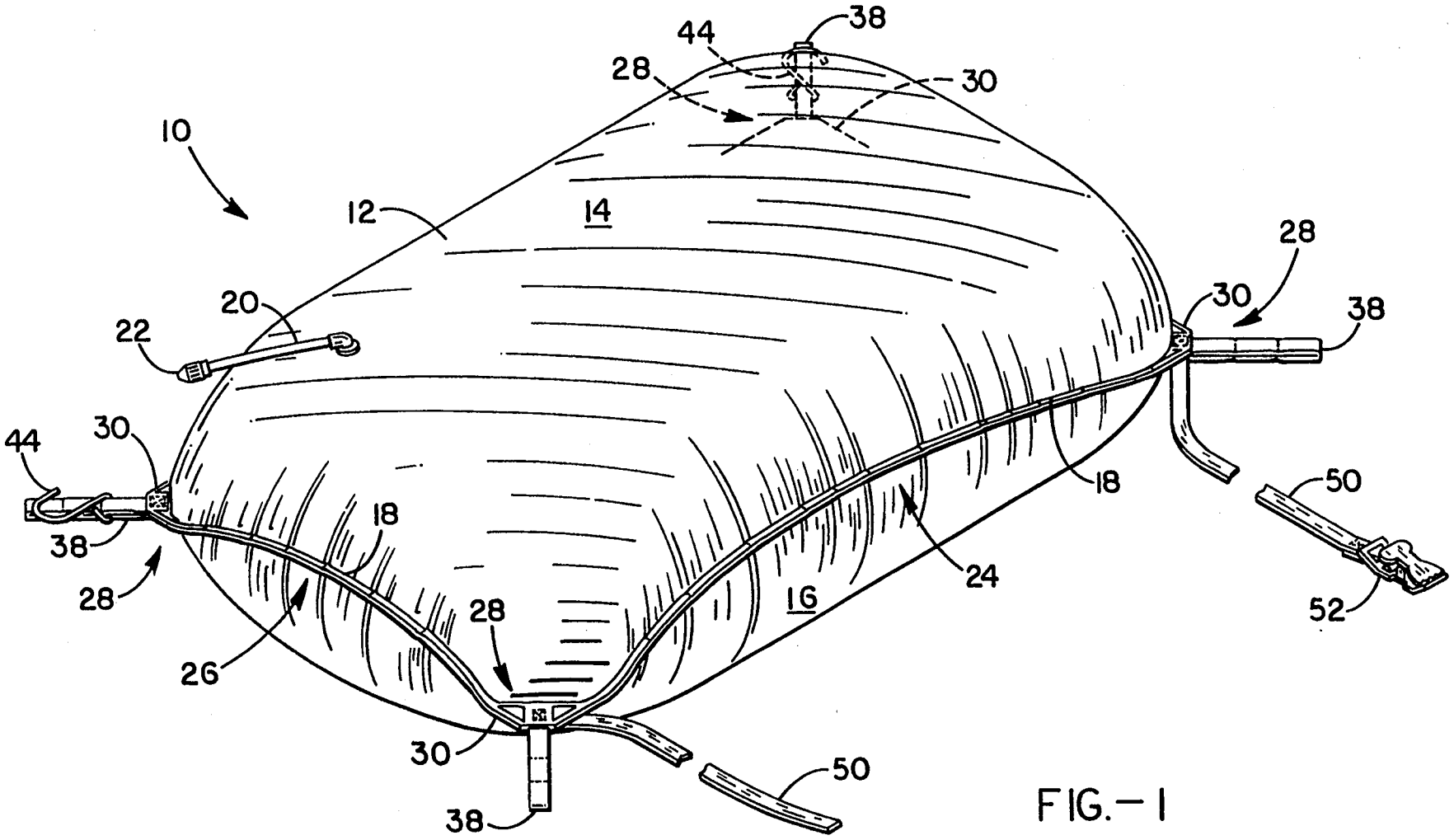
FIG. 1 is a perspective view of a single floatation unit of the present invention.

Referring now specifically to the drawings, FIG. 1 shows the preferred individual floatation unit of the floatation apparatus present invention, this unit being generally identified herein with the reference numeral 10. The primary buoyant portion of floatation unit 10 is air bag 12. Air bag 12 is comprised of first and second flexible panels, these panels being identified with reference numerals 14 and 16, respectively.

Panels 14 and 16 are constructed of flexible, fluid-impervious material. Vinyl sheets 20 mil. in thickness have been used with success for lighter duty use, and 220 denier nylon oxford fabric with urethane coating has been used for heavier duty applications. These materials are readily available in the trade from many different sources. Other flexible, fluid-impervious materials may also work as well.

In consideration of the purposes to which floatation unit 10 is intended to be put, as are fully explained below, certain dimensions are preferred. It has been determined that to yield a roughly rectangular, pillow-shaped unit 20 inches wide, 30 inches long and 15 inches thick upon inflation, panels 12 and 14 must be approximately 22 inches wide and 36 inches long.

Panels 14 and 16 are hermetically sealed to one another at seam 18. Thermal welding known as "RF (radio frequency) welding" is preferred in creating seam 18, although adhesives and other seam sealing products and methods may be employed, depending upon the material used for panels 14 and 16. Once sealed together at seam 18, air bag 12, comprised of panels 14 and 16, is capable of being inflated and retaining air under pressure.

Floatation unit 10 further includes inflation hose 20 with end valve 22 at its terminus. Hose 20 may be attached to either panel 14 or 16, using techniques well-known in the art for achieving an hermetic seal between a hose and a panel. End valve 22 may be one of several commonly available styles such as a pin valve having an axial pin which is pulled outward with the teeth to open the valve, and which is pushed in to close the valve. A twist valve which is opened by rotation in a counter-clockwise direction, and closed by clockwise rotation may also be employed. Other well-known valve styles may also work well, whether they are disposed on the end of a hose, as preferred, or whether they are just built flush into the surface of a panel, as is also common.

Air bag 12 has two long edges 24 and two short edges 26 along seam 18. Edges 24 and 26 are bowed slightly inward when air bag 12 is inflated. Being generally rectangular, air bag 12 has four corner regions 28.

Figure 3:
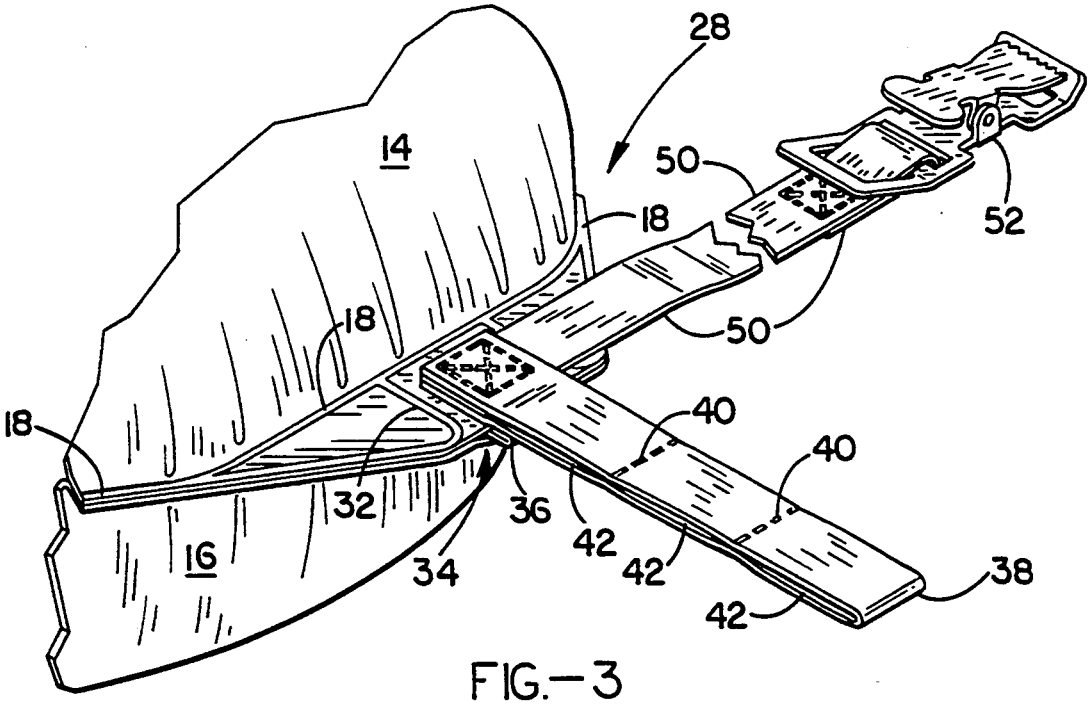
FIG. 3 is an enlarged fragmentary perspective of a corner of a floatation unit showing attachment of a cinch strap.
Figure 2:
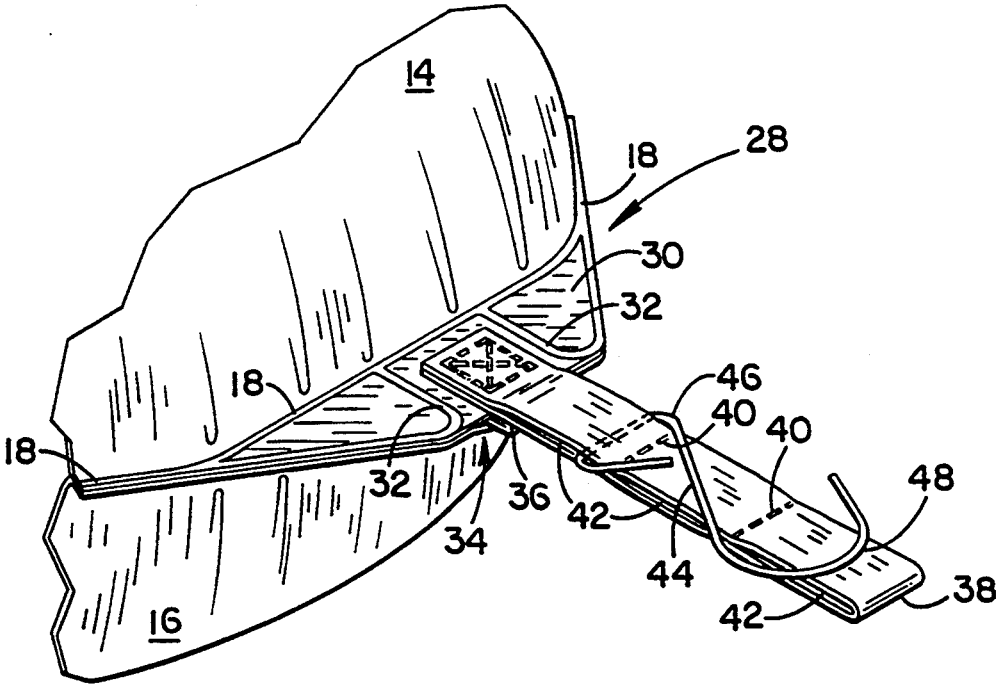
FIG. 2 is an enlarged fragmentary perspective of a corner of a floatation unit showing attachment of a hook to a long folded grab loop.

As best seen in FIGS. 2 and 3, at each of these four corner regions 28, seam 18 is brought in some distance from the edges of panels 14 and 16, thereby leaving an uninflatable tab portion 30 at each corner. Additional seam elements 32 project outward from seam 18 on tabs 30, these outward-projecting seam elements 32 forming pocket 34 between panels 14 and 16 at each corner. A short, projecting folded loop 36 of textile fabric webbing is sewed into each pocket 34 at each corner tab 30. Short loop 36 preferably projects sufficiently to receive a D-ring, or the like.

A longer folded loop 38 of textile fabric webbing is sewed to one of the outer faces of pocket 34, right over short loop 36. Longer loop 38 is generally referred to herein as a "grab loop." Each grab loop 38 preferably includes two cross-stitched seams 40, thus breaking grab loop 38 into three separate portions, each having an aperture 42 therethrough.

The textile fabric webbing used in the construction of loops 36 and 38 is preferably nylon or polypropylene. And, each grab loop is oriented on a corner 28 at approximately 45° to the adjacent edges 24 and 26 of air bag 12, thus causing the loops to project diagonally outward from the bag, making them easier to grab. Of course, grab loops 38 should be long enough to facilitate their being easily grasped with the hand.

As best seen in FIG. 2, two of the grab loops 38 are fitted with rigid hooks 44 through their apertures 42. The loops to which hooks 44 are fitted are preferably directly opposed with a long edge 24 between them. That is, they are preferably not diagonally opposed, nor are they directly opposed with a short edge 26 between them.

Hooks 44 have a loop-engaging portion 46 and a hardware-engaging portion 48. Loop engaging portion 46 has a closed configuration for secure engagement with grab loop 38 through one of its apertures 42. However, portion 46 is not so tightly configured as to prevent its being removed from engagement with grab loop 38 at one aperture 42 and moved to another aperture. Hardware-engaging portion 48 of hook 44 has an open configuration for engaging objects to which it may be desired that floatation unit 10 be attached.

The remaining two corner tabs 30 (i.e. the corners directly opposed from those with the hooks, and having the other long edge 24 between them) include cinch straps 50 sewed thereto. One cinch strap 50 has a free end and the other has a terminal spring-biased buckle 52 which permits straps 50 to be fastened to one another, or to other like straps. Cinch straps 50 should be constructed of the preferred textile fabric webbing and should be approximately 30 inches long. They are securely sewed to pocket 34 where short loop 36 and grab loop 38 are attached to corner tab 30. This is best shown in FIG. 3.

Figure 4:
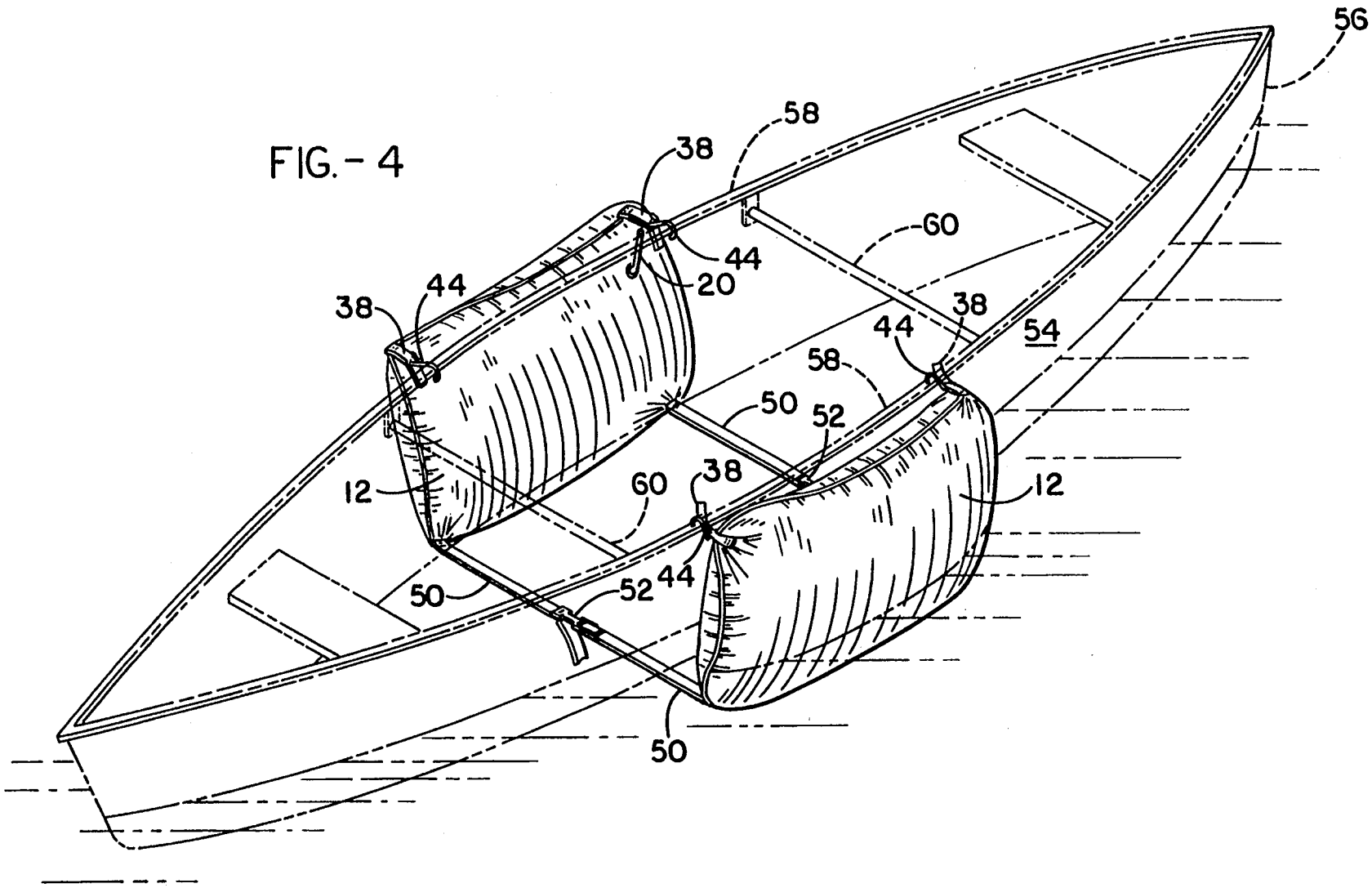
FIG. 4 is a perspective view of a pair of floatation units in place for stabilizing a water craft.

In use, the above-described floatation unit 10 is very versatile. It constitutes a basic unit which can be combined with other like units, or with other apparatus, to perform several different functions, and to comprise several different inventive combinations and methods of use. For example, as shown in FIG. 4, in one mode of use a pair of the inventive devices 10 may be placed along opposing sides 54 of a water craft such as a canoe 56 to achieve a stabilizing effect. Floatation units 10 are engaged with a water craft by hooking the hardware-engaging portion 48 of hook 44 to the water craft's opposing gunwales 58 amidships. Thus, in this orientation, hooks 44 are on the topmost portion of unit 10. Hooks 44 may be moved to any aperture 42 in grab loop 38 that best accommodates the size and shape of gunwale 58. If the water craft to which floatation units 10 are to be attached has an oddly shaped gunwale, or a structure other than a conventional gunwale amidships, several options are available. Alternative-shaped hooks or other attaching hardware may be fitted to grab loop 38. Short loop 36 may be employed to hold a hook or other attaching hardware such as a D-ring, as well. And, short loop 36 and grab loop 38 may be used simultaneously, as by having a loop strung through them and around some anchoring hardware on the water craft, or by fitting them both with different types of hooks. In this mode of use, the pair of floatation units 10 are tethered together between their lower-most portions with cinch straps 50 which pass beneath the water craft. Once cinched up, cinch straps maintain a tension tending to draw bags 12 toward one another, thereby biasing the hooks of each bag against their respective gunwale.

Figure 5:
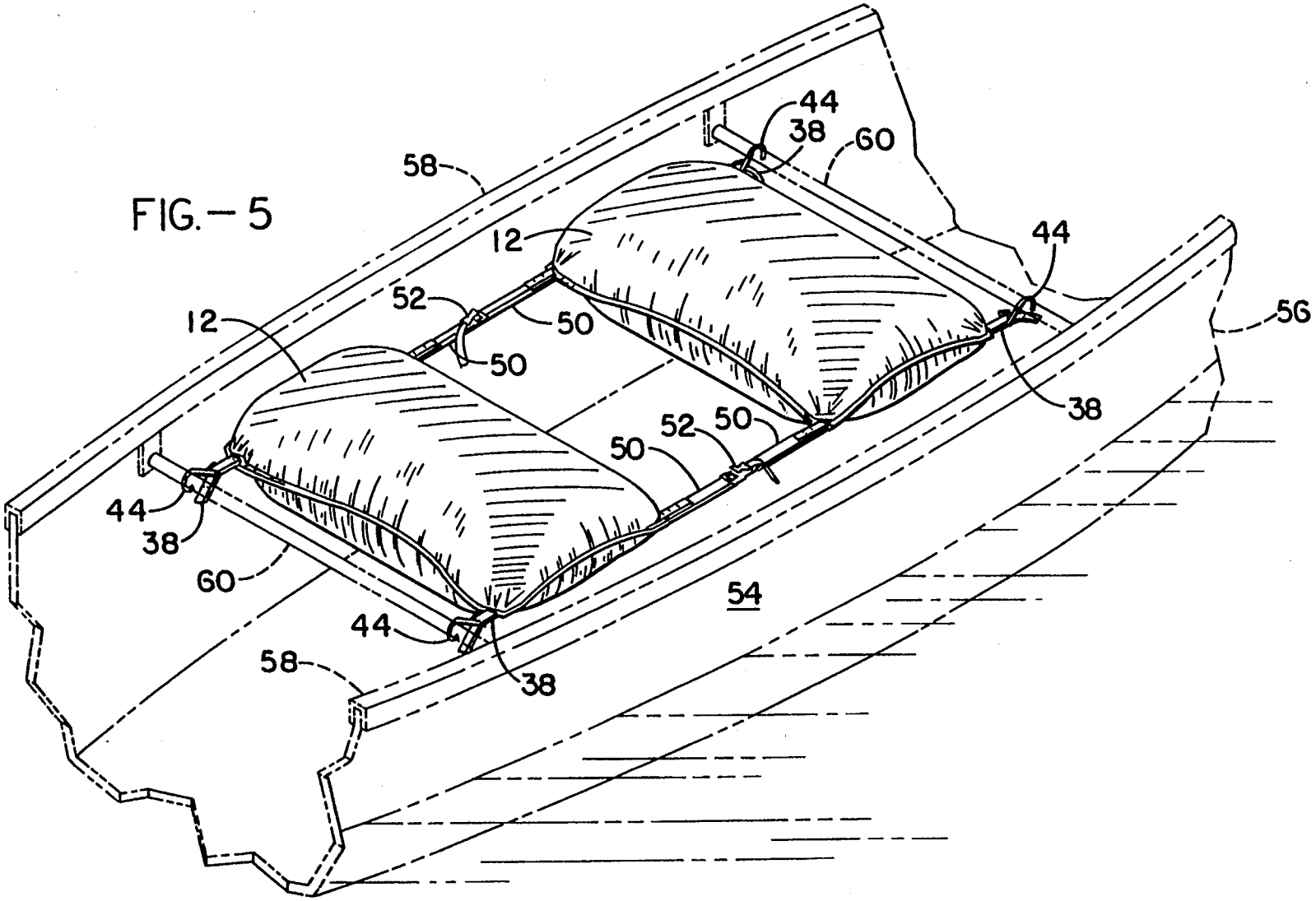
FIG. 5 is a perspective view of a pair of floatation units in place for displacing space inside a water craft.

In another mode of use, as shown in FIG. 5, a pair of floatation units 10 may be employed for displacement of space within a water craft. Inflated air bags of various types are commonly used for this purpose in all kinds of water craft. However, a pair of the inventive floatation units 10 are particularly stable and easy to install as between thwarts 60 in a water craft such as a canoe 56. In that case, cinch strap 50's buckle 52 of a first floatation unit 10 is buckled to the free end of a cinch strap on a second floatation unit and, in turn, the buckle 52 of the second is buckled to the free ended cinch strap of the first. Hooks 44 of the first unit are engaged with a first thwart 60, and hooks 44 of a second unit are hooked to an opposing second thwart 60. Once all cinch straps 50 are pulled tight, first and second floatation units 10 are drawn toward one another and securely suspended between the thwarts with which hooks 44 are engaged. Thus, as with all space-displacing apparatus, if the water craft is swamped, floatation units 10 maintain air spaces within the craft to help prevent its sinking. Of course, as more floatation units 10 are mounted within the water craft more water can be displaced, thereby further insuring against the water craft's sinking. If the water craft with which floatation units 10 are to be used has no thwarts, hooks 44 may be engaged with other anchoring hardware within the craft. Or, the hooks may be replaced with other hardware-engaging elements as suggested above.

It is to be understood that the dimensions of units 10, in this use, may be altered to accommodate the specific water craft being stabilized. Specifically, it is preferred that the width of the air bag 12 have a dimension approximately equal to the height of the water craft's gunwale from the water craft's water line.

Figure 6A:
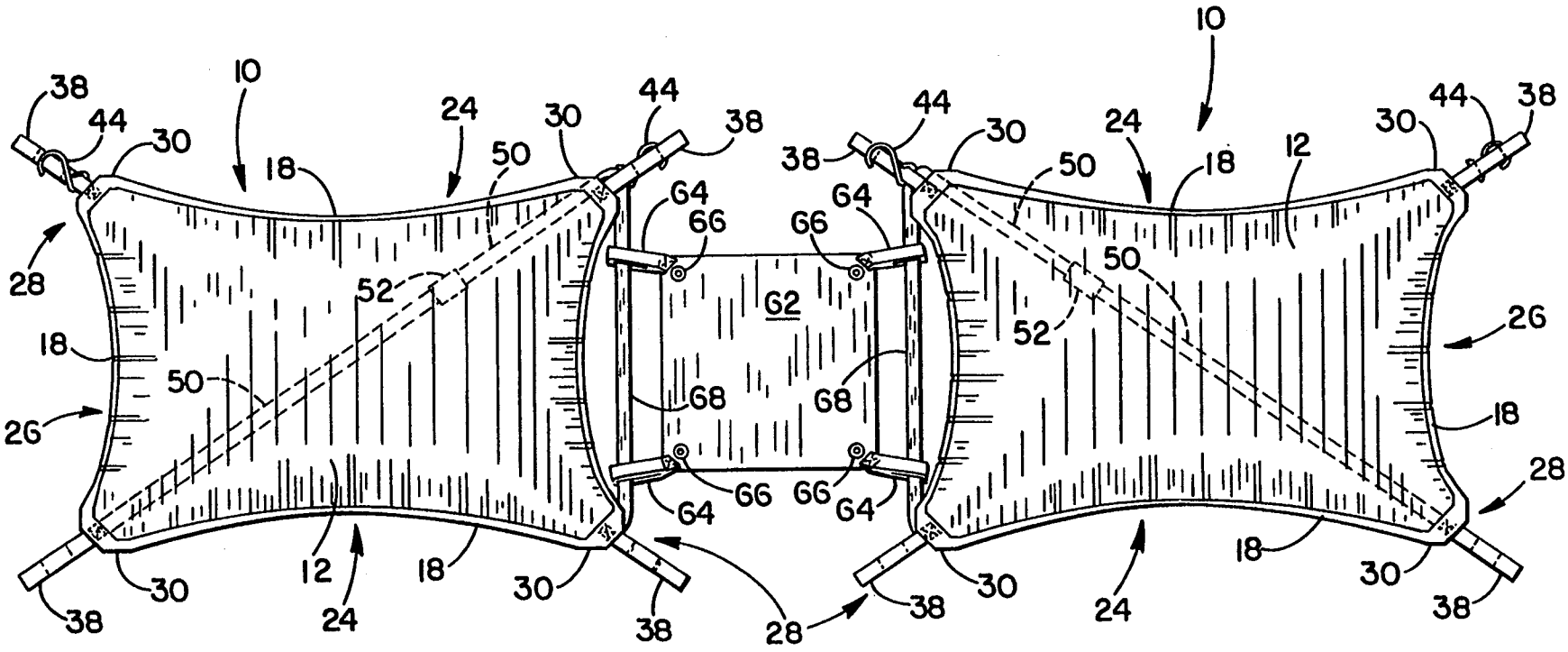
FIG. 6*a* is a top plan view of a pair of floatation units with their cinch straps configured to support a seat panel between them.
Figure 6B:
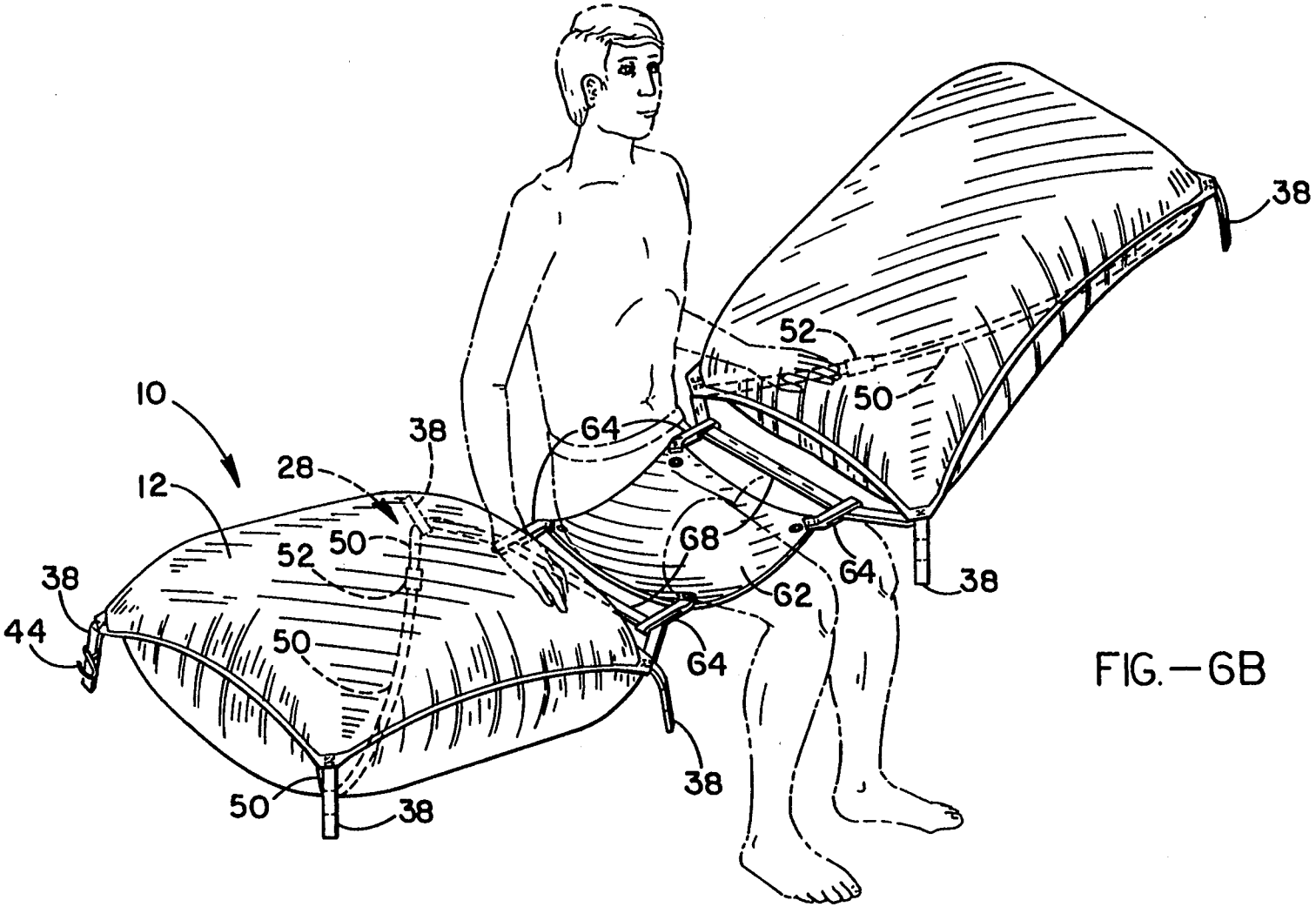
FIG. 6*b* is a perspective view of a person supported in water on a pair of floatation units configured as in FIG. 6*b* with a seat panel between them.

A further alternative use of the inventive floatation unit 10 is shown in FIGS. 6*a* and 6*b*. Therein, seat panel 62 is seen to be supported between a pair of floatation units 10. Seat panel 62 is comprised of a square sheet of reinforced, waterproof textile fabric approximately 12 inches square and hemmed at its edges. Corner loops 64 are securely fastened to all four corners of seat panel 62, each of these being constructed of a length of the preferred textile fabric webbing roughly 10 inches long. This webbing is doubled over and sewed to panel 62. Grommets 66 help reinforce the corners of seat panel 62's hemmed edges, and provide additional attachment points for hooks, tethers and the like.

Seat panel 62 is preferably suspended between short edges 26 of a pair of units 10. This permits a person, as shown in FIG. 6*b*, to be supported substantially upright in the water. And, the person needs merely to press downward on air bags 12 to raise the height of seat panel 62 in the water. To suspend seat panel 62 at short edges 26, straps 50 must be properly configured. Thus, a cinch strap 50 is run parallel to a short edge 26, and through that aperture 42 of directly opposed grab loop 38 nearest to its tab 30. From there, cinch strap 50 is run in a diagonal direction toward the diagonally opposed corner where the second cinch strap 50 is anchored, (cinch straps 50 being anchored to directly opposed corners with a long edge 24 between them). Buckle 52 may be disposed on one or the other of cinch straps 50 but, in any case, is employed to bind the two together in a taut posture diagonally across the surface of air bag 12. This results in a short portion 68 of one strap 50 tautly spanning the gap between directly opposing corner tabs 30 along slightly bowed short edge 26. If two floatation units 10 are employed, and a short strap portion 68 of each passes through two directly opposed corner loops 64 of seat panel 62, then seat panel 62 will be supported equally from two sides as shown in FIG. 6*a*. This arrangement provides a comfortable water support for a person, as shown in FIG. 6*b*.

Figure 7:
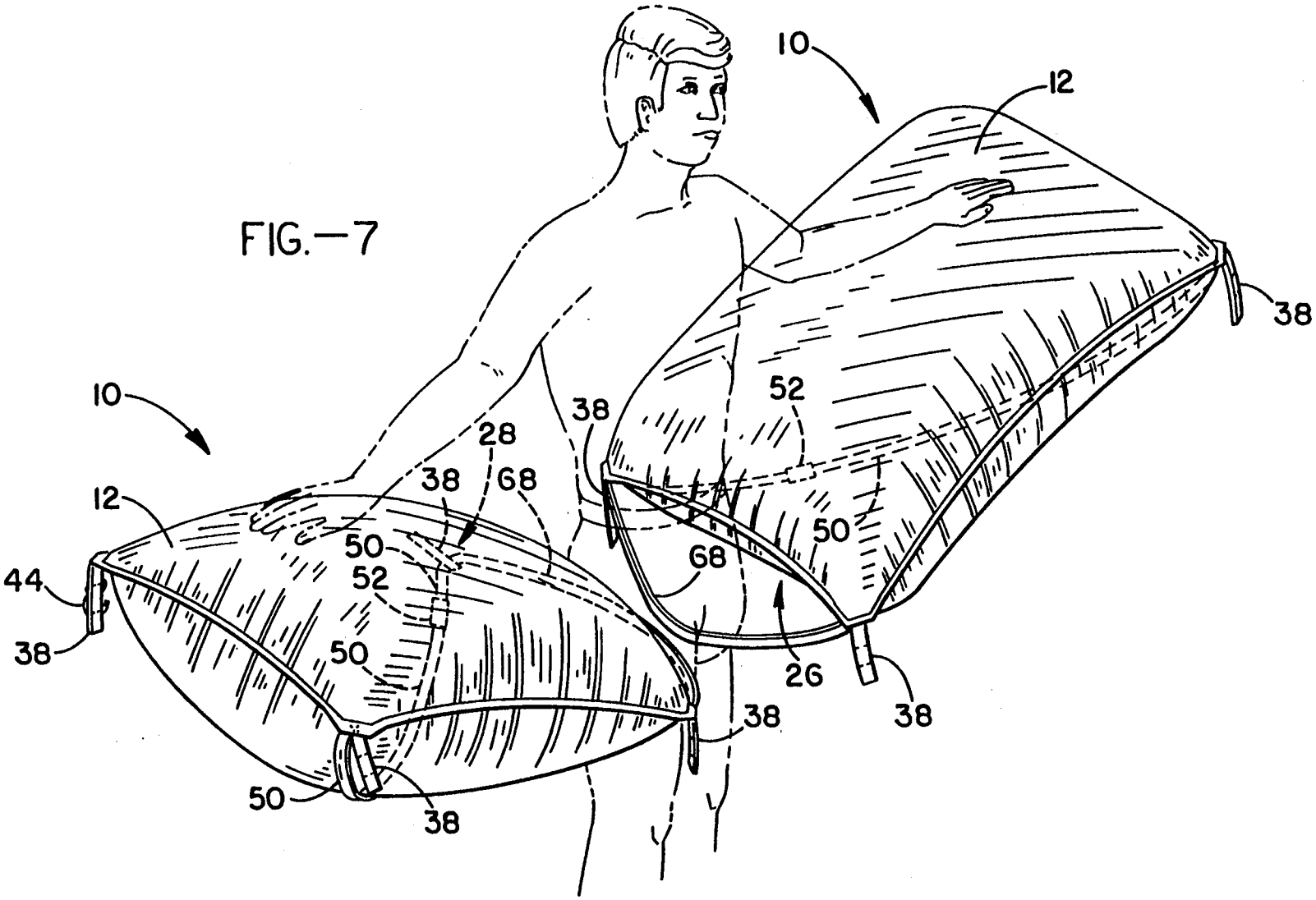
FIG. 7 is a perspective view of a person supported in water by having each leg through a gap between a cinch strap and the short end of a floatation unit's air bag.

A pair of floatation units 10 may also be used without a seat, if desired, to support a person in a substantially upright orientation in the water. As shown in FIG. 7, in this instance cinch straps 50 may be configured in a fashion similar to that suggested above for supporting seat panel 62, although here units 10 remain separate and unconnected. Each of a person's legs may be passed through the gap between short strap portion 68 and short edge 26 of air bag 12. Thus, once cinched up, straps 50 hold the person's thighs securely against each air bag and support the person in water from the crotch between the legs. Again, if the person desires to be supported higher in the water, air bags 12 merely need to be pressed downward.

A variation on the immediately previous theme is shown in FIG. 8 where straps 50 are buckled together along the long edges 24 of air bags 12, thereby creating gaps therebetween. When each of a person's legs are passed through gaps of a pair of floatation units 10 so configured, air bags 12 sit somewhat lower in the water and create support surfaces for the person's arms at a comfortable height on both sides of the torso. This is an especially comfortable arrangement for fishing.

Finally, as a simple floatation aid for a person in a more prone position in the water, cinch straps 50 of a single unit 10 may be buckled together around a person's torso. Then, as in FIG. 9, the upper chest and arms are supported atop air bag 12 while the hips and legs hang free for kicking. Cinch straps 50 remain buckled together, but are preferably somewhat loose to prevent the person's becoming entangled in unit 10 in an emergency.

In all embodiments and uses of the invention, grab loops 38 permit a person to handle a unit 10 more easily in normal use, or to grasp a secure hold on a unit in an emergency.

Thus, the basic, individual floatation unit 10 is comprised of the foregoing elements, and can be used in the described ways. It is, by itself, inventive, and it is also inventive in combination with a plurality of like units, as well as in combination with other apparatus. The described methods of use are also inventive.

The foregoing detailed disclosure of the inventive floatation unit 10 is considered as only illustrative of the preferred embodiment of, and not a limitation upon the scope of, the invention. Those skilled in the art will envision many other possible variations of the structure disclosed herein that nevertheless fall within the scope of the following claims. And, alternative uses for this inventive floatation unit may later be realized. Accordingly, the scope of the invention should be determined with reference to the appended claims, and not by the examples which have herein been given.

I claim:

1. A floatation unit, comprising:

a. a generally rectangular air bag having four generally defined corners;

b. means for inflating said air bag;

c. a grab loop fastened to each of said air bag's four corners;

d. a hook fitted to each of two of said air bag's directly opposed corners;

e. a cinch strap fastened to each of those two of said air bag's corners not having a hook, said corners with cinch straps being directly opposed to one another; and, f. means bound to an end of one of said cinch straps for attachment to a free end of the other of said straps.

2. The floatation unit of claim 1, wherein each said grab loop is oriented at approximately 45° to edges of said air bag adjacent said grab loop's corner, thus causing said loops to project diagonally outward from said air bag's corners.

3. The floatation unit of claim 1, wherein said grab loops comprise folded strips of flexible textile fabric.

4. The floatation unit of claim 1, wherein each said grab loop is sized to permit said loop to be grasped securely by one's hand.

5. The floatation unit of claim 1, wherein said attachment means comprises at least one spring-biased buckle.

6. The floatation unit of claim 1, wherein the manner in which each said hook is fitted to its respective corner is by engaging it with its respective grab loop.

7. The floatation unit of claim 1, wherein each said hook is adapted to permit secure engagement with hardware of a watercraft.

8. The floatation unit of claim 7, wherein said watercraft's hardware which said hook is adapted to engage is a gunwale.

9. The floatation unit of claim 8, wherein said gunwale is a gunwale of a canoe.

10. The floatation unit of claim 1, wherein each said hook is rigid and comprised of a first part adapted for being securely fitted to its respective corner, and a second part adapted for engagement with hardware of a watercraft.

11. The floatation unit of claim 1, wherein said cinch straps have a combined length sufficient to permit their attachment to one another, via said attachment means.

12. The floatation unit of claim 1, wherein said cinch straps, when attached via said attachment means, are adjustable between a length sufficiently short hold a person's thigh securely against said air bag, and sufficiently long to permit passage of a person's torso between said attached cinch straps and said air bag.

13. The floatation unit of claim 1, wherein said cinch straps are of such lengths that they, when attached via said attachment means, comprise a contiguous strap of sufficient length to pass from a corner where one cinch strap is fastened, along a side edge of said air bag, through a grab loop on a directly opposing corner, that opposing corner having a hook, and diagonally across said air bag to that corner where the other of said cinch straps is fastened.

14. The floatation unit of claim 1, further including a second flotation unit substantially as described, and yet further including a generally rectangular flexible seat panel having means for receiving said cinch straps, whereby said seat panel may be suspended between said floatation unit and said second flotation unit for support of a person.

15. The floatation unit of claim 14, wherein said strap receiving means comprises a plurality of corner loops.

16. The floatation unit of claim 14, wherein a portion of one of said cinch straps of each said floatation unit runs generally parallel to a side edge of its respective air bag and through strap receiving means of said seat panel, thereby supporting said panel in water.

17. A floatation unit, comprising:

a. an air bag including a first generally rectangular panel of flexible, fluid-impervious material and a second panel of a size, shape and material similar to said first panel, said first and second panels being hermetically sealed to one another around their respective edges, thereby forming a common seam;

b. means for inflating said air bag whereby, when inflated, said air bag has four generally defined corners;

c. a first grab loop fastened to a first of said air bag's four corners;

d. a first hook fitted to said first grab loop;

e. a second grab loop fastened to a second of said air bag3 s four corners, said second corner being adjacent, and not diagonally opposed to, said air bag's first corner;

f. a third grab loop fastened to a third of said air bag's four corners;

g. a first elongate, flexible cinch strap, said first strap being fastened to said third corner of said air bag;

h. a fourth grab loop fastened to a fourth of said air bag's four corners; and, i. a second elongate, flexible cinch strap, said strap being fastened to said fourth corner of said air bag, said strap having means bound thereto for attachment to a free end of said first strap.

18. The floatation unit of claim 17, wherein the manner in which each said hook is fitted to its respective corner is by engaging it with its respective grab loop.

19. The floatation unit of claim 17, wherein each said hook is dimensioned to permit secure engagement with hardware of a watercraft.

20. The floatation unit of claim 19, wherein said watercraft's hardware is a gunwale.

21. The floatation unit of claim 20, wherein said gunwale is a gunwale of a canoe.

22. The floatation unit of claim 17, wherein each said hook is rigid and comprised of a first part adapted for being securely fitted to its respective corner, and a second part adapted for engagement with hardware of a watercraft.

23. The floatation unit of claim 17, wherein said first strap and second strap have a combined length sufficient to permit their attachment to one another, via said attachment means of said second strap.

24. The floatation unit of claim 17, wherein said first cinch strap and said second cinch strap are of such lengths that they, when attached via said attachment means of said second strap, comprise a contiguous strap of sufficient length to pass from said third corner, along a side edge of said bag, through a grab loop on a directly opposing corner and diagonally across said bag to said fourth corner.

25. The floatation unit of claim 17, further including a second flotation unit substantially as described, and yet further including a generally rectangular flexible seat panel having means for receiving said cinch straps, whereby said seat panel may be suspended between said floatation unit and said second flotation unit for support of a person.

26. The floatation unit of claim 25, wherein said strap receiving means comprises a plurality of corner loops.

27. The floatation unit of claim 25, wherein a portion of one of said cinch straps of each said floatation unit runs generally parallel to a side edge of its respective air bag and through strap receiving means of said seat panel, thereby supporting said panel in water.

28. Apparatus for increasing a water craft's stability, comprising:

a. a first floatation unit;

b. means for hooking said first floatation unit to a port gunwale of said water craft;

c. a second floatation unit;

d. means for hooking said second floatation unit to a starboard gunwale of said watercraft; and, e. elongate, flexible means for tethering said first floatation unit to said second floatation unit, wherein said tethering means is adapted to pass beneath said water craft, wherein said first and second floatation units each comprise:

i. a generally rectangular air bag having four generally defined corners;

ii. means for inflating said air bag;

iii. a grab loop fastened to each of said air bag's four corners;

iv. a hook fitted to each of two of said air bag's directly opposed corners;

v. a cinch strap fastened to each of those two of said air bag's corners not having a hook, said corners with cinch straps being directly opposed to one another; and, vi. means bound to an end of one of said cinch straps for attachment to a free end of the other of said straps.

29. Apparatus for displacing space within a water craft, comprising:

a. a first floatation unit;

b. means for hooking said first floatation unit to a first thwart of said water craft;

c. a second floatation unit;

d. means for hooking said second floatation unit to a second thwart of said watercraft;

e. elongate, flexible means for tethering said first floatation unit to said second floatation unit; and, f. means for tensioning said tethering means whereby, when tensioned, said floatation units are drawn toward one another, thereby causing said first and second hooking means to engage said thwarts securely and to suspend said floatation units within said watercraft, wherein said first and second floatation units each comprise:

i. a generally rectangular air bag having four generally defined corners;

ii. means for inflating said air bag;

iii. a grab loop fastened to each of said air bag's four corners;

iv. a hook fitted to each of two of said air bag's directly opposed corners;

v. a cinch strap fastened to each of those two of said air bag's corners not having a hook, said corners with cinch straps being directly opposed to one another; and, vi. means bound to an end of one of said cinch straps for attachment to a free end of the other of said straps.

30. Apparatus for supporting a person in water, comprising, in combination:

a. a first generally rectangular air bag;

b. a strap fastened between a first corner and a second directly opposed corner of said first air bag;

c. a second generally rectangular air bag substantially similar in dimension to said first air bag; and, d. a strap fastened between a first corner and a second directly opposed corner of said second air bag, whereby a person may pass a first leg between said first strap and said first air bag, and a second leg between said second strap and said second air bag to be supported substantially upright on the surface of a body of water.

* * * * *